US009396685B2

(12) United States Patent
Kim

(10) Patent No.: US 9,396,685 B2
(45) Date of Patent: Jul. 19, 2016

(54) ORGANIC LIGHT EMITTING DISPLAY DEVICE AND METHOD FOR DRIVING THEREOF THAT REDUCES POWER CONSUMPTION IN A STANDBY MODE

(75) Inventor: Mi-Hae Kim, Yongin (KR)

(73) Assignee: Samsung Display Co., ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 711 days.

(21) Appl. No.: 13/094,989

(22) Filed: Apr. 27, 2011

(65) Prior Publication Data

US 2012/0001950 A1 Jan. 5, 2012

(30) Foreign Application Priority Data

Jun. 30, 2010 (KR) ..... 10-2010-0062762

(51) Int. Cl.

| | |
|---|---|
| ***G09G 3/30*** | (2006.01) |
| ***G09G 3/32*** | (2016.01) |
| *G09G 3/10* | (2006.01) |
| *G09G 3/00* | (2006.01) |

(52) U.S. Cl.

CPC ..... *G09G 3/3291* (2013.01); *G09G 3/006* (2013.01); *G09G 2310/0297* (2013.01); *G09G 2310/04* (2013.01); *G09G 2320/0686* (2013.01); *G09G 2330/021* (2013.01)

(58) Field of Classification Search

CPC ..... G09G 3/006; G09G 3/3291
USPC ..... 345/77, 904; 315/169.3
See application file for complete search history.

(56) References Cited

U.S. PATENT DOCUMENTS

| | | | | |
|---|---|---|---|---|
| 2001/0022565 | A1* | 9/2001 | Kimura | 345/82 |
| 2003/0197472 | A1 | 10/2003 | Kanauchi et al. | |
| 2004/0233226 | A1 | 11/2004 | Toriumi et al. | |
| 2006/0022929 | A1 | 2/2006 | Hashimoto et al. | |
| 2006/0107143 | A1 | 5/2006 | Kim et al. | |

(Continued)

FOREIGN PATENT DOCUMENTS

| | | |
|---|---|---|
| CN | 1759430 A | 4/2006 |
| CN | 201041734 | 3/2008 |

(Continued)

OTHER PUBLICATIONS

Korean Office Action issued May 22, 2012 in connection with Korean Patent Application Serial No. 10-2010-0062762 and Request for Entry of the Accompanying Office Action attached herewith.

(Continued)

*Primary Examiner* — Adam J Snyder
(74) *Attorney, Agent, or Firm* — Robert E. Bushnell, Esq.

(57) ABSTRACT

A method for driving an organic light emitting display device that is able to minimize power consumption while in a standby mode. In order to decrease power consumption during standby mode, only a portion of the display corresponding to the standby mode display area displays an image while in standby mode, and a remainder of the image producing display displays black. The method includes sequentially supplying a scanning signal to the standby mode display region and the standby mode non-display region, supplying a data signal in response to the image in a data driver when supplying the scanning signal to the standby mode display region and supplying the data signal in response to a black image from an inspecting unit while supplying the scanning signal to the standby mode non-display region.

20 Claims, 4 Drawing Sheets

(56) References Cited

U.S. PATENT DOCUMENTS

| | | | | |
|---|---|---|---|---|
| 2006/0152460 | A1 | 7/2006 | Toyozawa et al. | |
| 2007/0046581 | A1 | 3/2007 | Kwak et al. | |
| 2007/0063959 | A1* | 3/2007 | Iwabuchi et al. | 345/100 |
| 2007/0080913 | A1* | 4/2007 | Park et al. | 345/87 |
| 2007/0091050 | A1* | 4/2007 | Katayama et al. | 345/98 |
| 2007/0139312 | A1* | 6/2007 | Kwak | 345/76 |
| 2007/0262929 | A1 | 11/2007 | Kim et al. | |
| 2008/0036704 | A1 | 2/2008 | Kim et al. | |
| 2009/0109147 | A1* | 4/2009 | Park et al. | 345/76 |
| 2009/0251455 | A1* | 10/2009 | Park et al. | 345/84 |
| 2011/0025670 | A1 | 2/2011 | Park et al. | |

FOREIGN PATENT DOCUMENTS

| | | | |
|---|---|---|---|
| JP | 2000047255 | A | 2/2000 |
| JP | 2003316315 | A | 11/2003 |
| JP | 2004233771 | A | 8/2004 |
| JP | 2006113548 | A | 4/2006 |
| JP | 2006178030 | A | 7/2006 |
| JP | 200758202 | A | 3/2007 |
| JP | 200765606 | A | 3/2007 |
| JP | 2007279655 | A | 10/2007 |
| JP | 200840451 | A | 2/2008 |
| JP | 2009109705 | | 5/2009 |
| KR | 1020070029842 | | 3/2007 |
| KR | 10-2008-0094240 | A | 10/2008 |
| KR | 1020090070371 | | 7/2009 |
| KR | 1020110013687 | A | 2/2011 |

OTHER PUBLICATIONS

European Search Report issued on Sep. 20, 2011 in connection with European Patent Application Serial No. 11170080.3, which also claims Korean Patent Application Serial No. 10-2010-0062762 as its priority document.

Korean Office Action issued on Nov. 9, 2011 in connection with Korean Patent Application Serial No. 10-2010-0062762 and Request for Entry of the Accompanying Office Action attached herewith.

Office Action dated Aug. 13, 2013 of the Chinese Patent Application No. 201110148514.8, which claims priority of the corresponding Korean priority application No. 10-2010-0062762.

Japanese Office Action issued by Japanese Patent Office on Apr. 1, 2014 corresponding to JP 2010-228890 which also claims KR 10-2010-0062762 as its priority document and Request for Entry of the Accompanying Office Action attached herewith.

Taiwanese Office Action issued by Taiwanese Patent Office on Dec. 30, 2013 in connection with Taiwanese Patent Application No. 100116233, which also claims Korean Patent Application No. 10-2010-0062762 as its priority document, with its English translation.

* cited by examiner

ORGANIC LIGHT EMITTING DISPLAY DEVICE AND METHOD FOR DRIVING THEREOF THAT REDUCES POWER CONSUMPTION IN A STANDBY MODE

CLAIM OF PRIORITY

This application makes reference to, incorporates the same herein, and claims all benefits accruing under 35 U.S.C. §119 from an application for ORGANIC LIGHT EMITTING DISPLAY DEVICE AND METHOD FOR DRIVING THEREOF earlier filed in the Korean Intellectual Property Office on 30 Jun. 2010 and there duly assigned Serial No. 10-2010-0062762.

BACKGROUND OF THE INVENTION

1. Field of the Invention

The embodiment relates to an organic light emitting display device that is able to minimize power consumption and a method for driving thereof.

2. Description of the Related Art

Recently, all sorts of flat panel display devices are being developed, in which the flat panel display device has a reduced volume and weight compared to that of a cathode ray tube. The flat panel display device includes a liquid crystal display, a field emission display, a plasma display panel, an organic light emitting display device, and the like.

The organic light emitting display device among the flat panel display devices is the device that an image is displayed using an organic light emitting diode that generates light by electron-hole recombination, and there is an advantage that it has a rapid response time and also can be driven with a low power consumption.

Actually, the organic light emitting display device is in use in various portable devices because it has the advantages, such as a high color reproduction, a thin thickness, and the like. With this configuration, the portable devices are driven as a driving mode for displaying fixed information and a standby mode for minimizing power consumption.

The portable device in the driving mode displays fixed image in response to an input from a user. The portable device in the standby mode displays a fixed image, for example, date, time, and the like in just a portion of a pixel unit to minimize power consumption.

However, when the fixed image is displayed in the portion of the pixel unit, power that is consumed by a data driver is the same for both the driving mode and the standby mode because a data signal in response to one screen is applied. Therefore, a method for minimizing power consumption of the data driver is required.

SUMMARY OF THE INVENTION

The embodiment is to provide an organic light emitting display device that is able to minimize power consumption and a method for driving thereof.

According to one aspect of the embodiment, there is provided a method for driving an organic light emitting display device, including providing the organic light emitting diode (OLED) display device that decreases power consumption when in a standby mode by displaying an image in only a standby mode display region of a pixel unit when in the standby mode while displaying black in a remaining standby mode non-display region of the pixel unit, sequentially supplying a scanning signal to both the standby mode display region and the standby mode non-display region of the pixel unit, supplying a data signal in response to the image via a data driver while the supplying of the scanning signal to the standby mode display region and supplying a data signal corresponding to a black image via an inspecting unit to the standby mode non-display region upon the supplying the scanning signal to the standby mode non-display region.

The inspecting unit may include a plurality of switching elements respectively arranged between a plurality of inspecting lines and a plurality of data lines, the switching elements being turned on when the scanning signal is being supplied to the standby mode non-display region. The inspecting lines may be supplied with a voltage that corresponds to the data signal corresponding to a black image. The method may also include stopping a supply of power to a buffer within the data driver upon the scanning signal being supplied to the standby mode non-display region during the standby mode.

According to another aspect of the present invention, there is provided an organic light emitting display (OLED) device that includes a scanning driver to supply a scanning signal to scanning lines during a driving mode and during a standby mode, a data driver to supply a data signal in response to an image to data lines while the scanning signal is being supplied a standby mode display region during the standby mode, an inspecting unit to supply a black data signal voltage corresponding to a black image to the data lines when the scanning signal is being supplied to the standby mode non-display region during the standby mode and a timing controller to supply an inspecting control signal to the inspecting unit.

The inspecting unit may include a plurality of inspecting lines that are supplied with the voltage corresponding to the black image and a plurality of switching elements that are respectively arranged between the data lines and the inspecting lines and being turned on when the inspecting control signal is being supplied. The timing controller may supply the inspecting control signal when the scanning signal is being supplied to the standby mode non-display region during the standby mode. The OLED display device may also include cutting off a supply of power to a buffer within the data driver upon the scanning signal being supplied to the standby mode non-display region during the standby mode. The OLED display device may also include a demux unit arranged between the data lines and an output of the data driver.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicated the same or similar components, wherein.

DETAILED DESCRIPTION OF THE INVENTION

Figure 1:
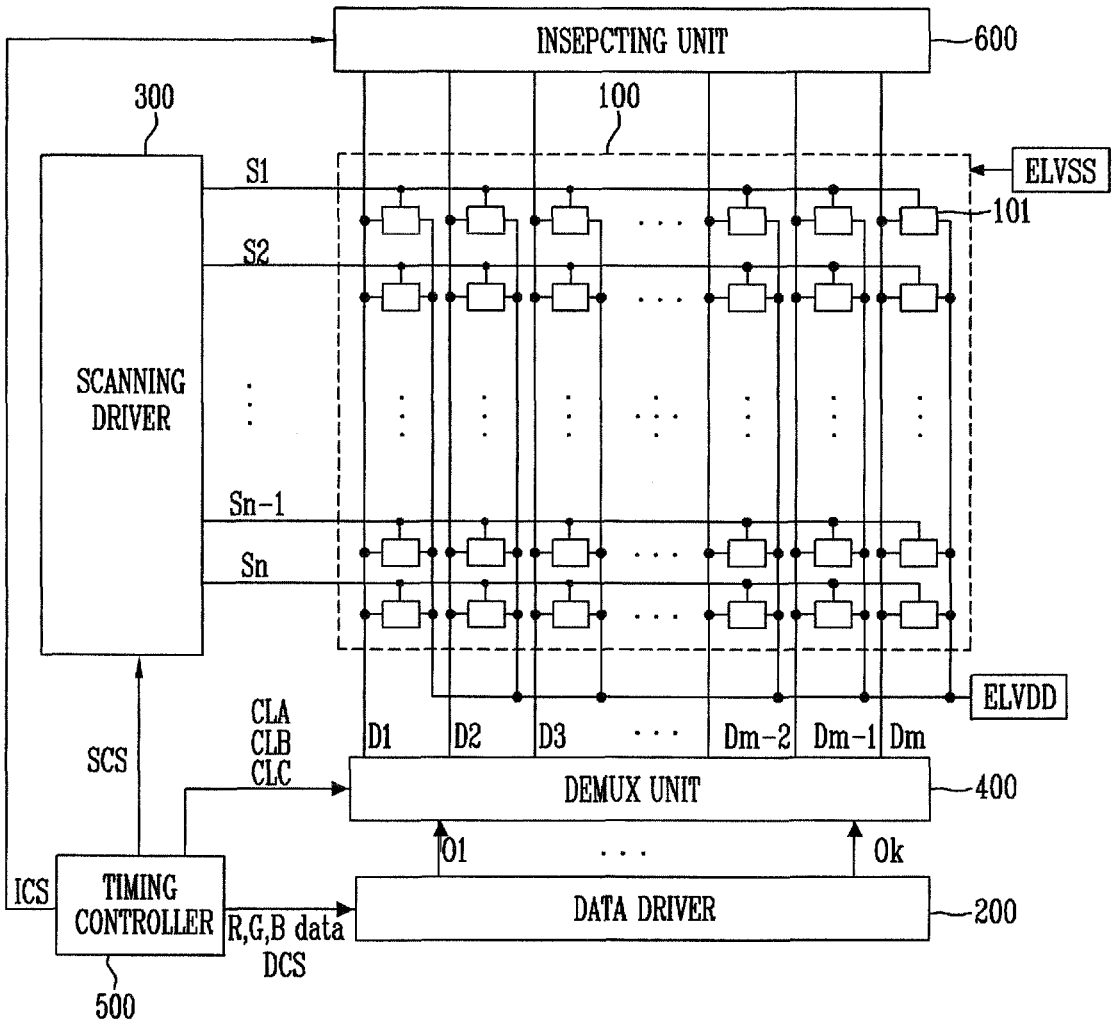
FIG. 1 is an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, the preferable embodiments of the present invention that can be easily implemented by the skilled person who has a general technique in the field including the present invention will be described in more detail with reference to the accompanying FIGS. 1 to 5.

Turning now to FIG. 1, FIG. 1 is an organic light emitting display device according to an embodiment of the present invention. Referring to FIG. 1, the organic light emitting display device according to the embodiment of the present invention includes a scanning driver 300 that drives scanning lines S1 to Sn, a data driver 200 that drives data lines D1 to Dm, a pixel unit 100 including a plurality of pixels 101 that are arranged at the intersection between the scanning lines S1 to Sn and the data lines D1 to Dm, a demux unit 400 that is connected between the data driver 200 and the data lines D1 to Dm, an inspecting unit 600 that is arranged to be connected to the data lines D1 to Dm, and a timing controller 500 that controls the data driver 200, the scanning driver 300, the demux unit 400 and the inspecting unit 600.

The scanning driver 300 is supplied with a scanning driving control signal (SCS) from the timing controller 500. The scanning driver 300 supplied with the scanning driving control signal (SCS) sequentially supplies scanning signals to the scanning lines S1 to Sn.

The data driver 200 is supplied with a data driving control signal (DCS) from the timing controller 500. The data driver 200 supplied with the data driving control signal (DCS) sequentially supplies a plurality of the data signals to output lines O1 to Ok.

When the organic light emitting display device is driven in a driving mode, the data driver 200 supplies the data signals to all the pixels 101 included in the pixel unit 100 via the output lines O1 to Ok. When the organic light emitting display device is driven in the standby mode, only a portion of the pixels 101 of pixel unit 100 display an image, this portion being called the standby display area. The standby display area is smaller than the driving display area, so that pixels not in the standby display area are black during standby mode. In standby mode, the data driver 200 supplies the data signals only to pixels 101 that are arranged within the standby display region of pixel unit 100 (the region that is displayed with an image during standby mode) via the output lines O1 to Ok. In standby mode, the data driver 200 does not supply data signals to the pixels 101 that are not arranged within the standby display region. Actually, the data driver 200 is set to an off state during the period when scanning signals are being supplied to the pixels 101 that are arranged in the standby mode non-display region, so that power consumption can be reduced. For example, during the period for supplying the scanning signal to the pixels 101 that are arranged in the standby mode non-display region, the data driver is set to the off state by not applying power to buffers (not shown) connected to the output lines O1 to Ok, so that power consumption can be minimized The demux unit 400 supplies the data signal that is delivered to the output terminal O1 to Ok of the data driver 200 to the data lines D1 to Dm. With this configuration, the demux unit 400 delivers a plurality of the data signals that are applied to each output terminal O1 to Ok to a plurality of the data lines D1 to Dm. For example, the demux unit 400 can deliver three data signals that are sequentially supplied to one output line O1 to three data lines D1, D2, D3.

To achieve this, the demux unit 400 is supplied with demux control signals CLA, CLB, CLC from the timing controller 500. The demux unit 400 supplied with the demux control signals CLA, CLB, CLC delivers three data signals that are supplied to each output line O1 to Ok to the data lines D1 to Dm in response to the demux control signals CLA, CLB, CLC.

A test of the organic light emitting display panels should be performed on a sheet unit (or mother substrate) before the organic light emitting display panels are separated from (i.e., scribed-apart from) the mother substrate. The inspecting unit 600 in the present invention supplies voltage, i.e., a black data signal in response to black to the pixels 101 that are arranged in the standby mode non-display region when driving in standby mode. The above-mentioned inspecting unit 600 also supplies fixed inspecting signals to the data lines D1 to Dm when inspecting the mother substrate before the organic light emitting display panel is separated from the mother substrate. In the embodiment of the present invention, voltage corresponding to black is applied to the data lines D1 to Dm when driving in the standby mode by using the inspecting unit 600 installed for testing the mother substrate before each organic light emitting display panel is separated from the mother substrate.

The pixel unit 100 includes a plurality of the pixels 101 that are connected to the scanning lines S1 to Sn and the data lines D1 to Dm. The pixels 101 are supplied with a second power (ELVSS) having the voltage level that is lower than a first power (ELVDD), and the first power (ELVDD). Each pixel 101 that is supplied with the first power (ELVDD) and the second power (ELVSS) displays the fixed image while controlling the current level that flows to the second power supply (ELVSS) from the first power supply (ELVDD) via the organic light emitting diode (now shown) in response to the data signal.

The timing controller 500 supplies the scanning driving control signal (SCS) to the scanning driver 300 and the data driving control signal (DCS) to the data driver 200. The timing controller 500 also rearranges the R, G, B data that are supplied from the outside and then supplies them to the data driver 200. In addition, the timing controller 500 supplies the demux control signals CLA, CLB, CLC to the demux unit 400 and supplies the inspecting control signal (ICS) to the inspecting unit 600. With this configuration, the inspecting control signal (ICS) is supplied to the standby mode non-display region during the period for supplying the scanning signal when driving in the standby mode.

Figure 2:
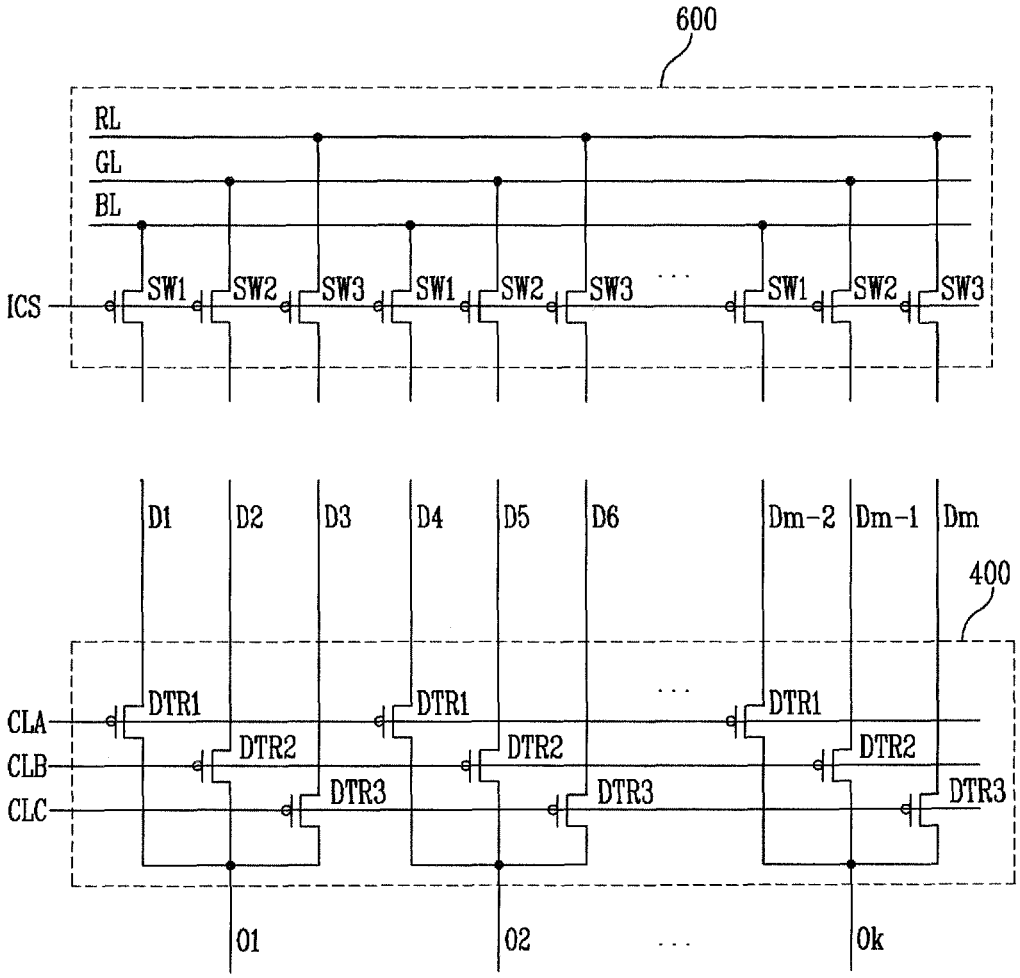
FIG. 2 is a detailed view of an inspecting unit and a demux unit of FIG. 1 according to an embodiment of the present invention.

Turning now to FIG. 2, FIG. 2 is a detailed view of an inspecting unit 600 and a demux unit 400 of FIG. 1 according to an embodiment of the present invention. For convenience, it is assumed that the demux unit 400 delivers the data signal that is supplied to one output line to three data lines in FIG. 2.

Referring to FIG. 2, the demux unit 400 includes a first demux transistor DTR1, a second demux transistor DTR2 and a third demux transistor DTR3. The first demux transistors DTR1 are arranged between ones of every third data line D1, D4, . . . , Dm-2 and ones of the output lines O1 to Ok, respectively. The above-mentioned first demux transistors DTR1 are turned on when the first demux control signal CLA is supplied, and then supply the data signal from the output line O1 to Ok to every third data line D1, D4, . . . , Dm-2.

The second demux transistors DTR2 are arranged between ones of every third data line D2, D5, . . . , Dm-1 and ones of the output lines O1 to Ok, respectively. The above-mentioned second demux transistors DTR2 are turned on when the second demux control signal CLB is supplied, and then supply the data signal from the output lines O1 to Ok to every third data line D2, D5, . . . , Dm-1.

The third demux transistors DTR3 are arranged between ones of every third data line D3, D6, . . . , Dm and ones of the output lines O1 to Ok, respectively. The above-mentioned third transistors DTR3 are turned on when the third demux control signal CLC is supplied, and then supply the data signal from the output lines O1 to Ok to every third data line D3, D6, . . . , Dm.

Meanwhile, the demux transistors DTR1 to DTR3 are repeatedly formed in the order of the first demux transistor DTR1, the second demux transistor DTR2, and the third demux transistor DTR3. With this configuration, the data signal from one output line can be supplied to three data lines D in response to the supplied order of the demux control signals CLA, CLB, CLC.

The inspecting unit 600 includes first switching elements SW1, second switching elements SW2, and third switching elements SW3. The first switching elements SW1 are arranged between the first inspecting line BL and ones of every third data line D1, D4, . . . , Dm-2, respectively. The above-mentioned first switching elements SW1 are turned on when the inspecting control signal ICS is supplied, and then allow every third data line D1, D4, . . . , Dm-2 to be electrically connected to the first inspecting line BL.

The second switching elements SW2 are arranged between the second inspecting line GL and ones of every third data line D2, D5, . . . , Dm-1, respectively. The above-mentioned second switching elements SW2 are turned on when the inspecting control signal ICS is supplied, and then allow the data line D2, D5, . . . , Dm-1 to be electrically connected to the second inspecting line GL.

The third switching elements SW3 are arranged between the third inspecting line RL and ones of every third data line D3, D6, . . . , Dm, respectively. The above-mentioned third switching elements SW3 are turned on when the inspecting control signal ICS is supplied, and then allow the data line D3, D6, . . . , Dm to be electrically connected to the third inspecting line RL.

Meanwhile, the inspecting control signal ICS is supplied from the timing controller 500 during portion of the time that the display is in the standby mode. And, the voltage in response to the high level, i.e., the black data signal is applied to the first to third inspecting line BL, GL, RL during the period for driving the panel as the driving mode and the standby mode. Actually, the first to third inspecting lines BL, GL, RL are used in the test of the mother substrate, and are supplied with the voltage of high level except during the inspecting period.

Figure 3:
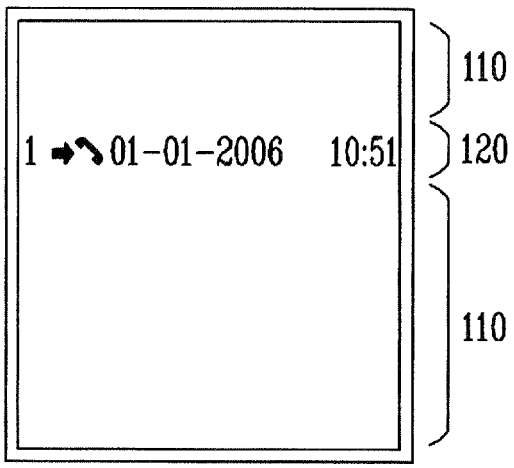
FIG. 3 is a view of a display displaying an image during standby mode according to an embodiment of the present invention.

Turning now to FIG. 3, FIG. 3 is a view of an image that is displayed on an organic light emitting display device when driving in a standby mode according to an embodiment of the present invention. Referring to FIG. 3, when driving the organic light emitting display device in the standby mode, the partial region of pixel unit 100 corresponding to region 120 in FIG. 3 is displayed with the fixed image.

When the organic light emitting display device is driven in the standby mode, the standby mode display region 120 and the standby mode non-display region 110 are divided. A date, time, and the like are displayed in the standby mode display region 120 and a black screen is displayed in the standby mode non-display region 110 during standby mode.

With this configuration, the fixed current flows in the pixels arranged in the standby mode display region 120 to display the fixed image. However, the current does not flow in the pixels arranged in the standby mode non-display region 110 that displays black. In other words, when the organic light emitting display device is driven in the standby mode, the amount of current that flows to the pixel unit 100 is smaller than when in driving mode, thereby decreasing power consumption.

Further, there is an advantage in that the black data signal is supplied to the pixels 101 arranged in the standby mode non-display region 110 using the inspecting unit 600, and also the data driver 200 is set in the off state, so that power consumption can be further decreased.

Figure 4:
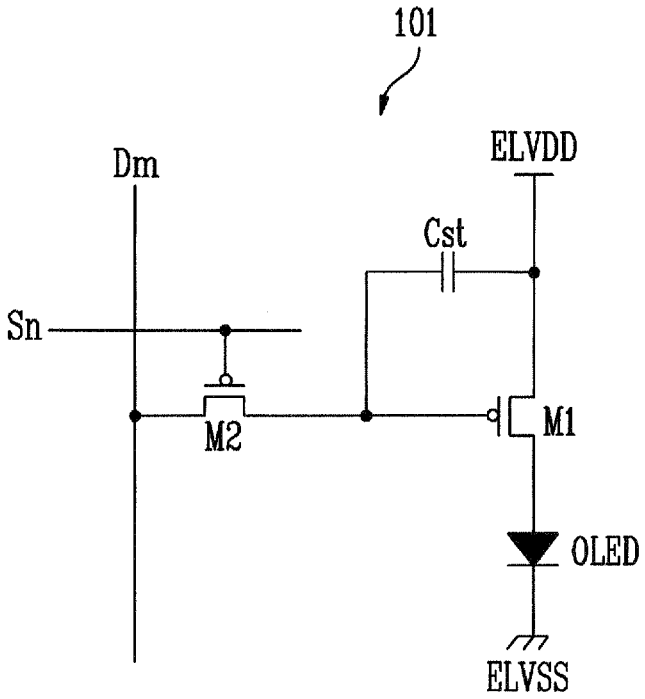
FIG. 4 is a view of a circuit for a pixel of FIG. 1 according to an embodiment of the present invention.

Turning now to FIG. 4, FIG. 4 is a circuit view showing a pixel 101 as depicted in FIG. 1 according to an embodiment of the present invention. Referring to FIG. 4, the pixel 101 according to the embodiment of the present invention include the first transistor M1, the second transistor M2, the storage capacitor Cst, and the organic light emitting diode OLED.

The anode electrode of the organic light emitting diode OLED is connected to the second electrode of the first transistor M1, and the cathode electrode is connected to the second power supply ELVSS. The above-mentioned organic light emitting diode OLED generates light of fixed luminance in response to the current amount that is supplied from the first transistor M1.

The first electrode of the first transistor M1 is connected to the first power supply ELVDD and the second electrode is connected to the anode electrode of the organic light emitting diode OLED. In addition, the gate electrode of the first transistor M1 is connected to one end of the storage capacitor Cst. The above-mentioned first transistor M1 supplies current to the organic light emitting diode OLED in response to the voltage charged in the storage capacitor Cst.

The first electrode of the second transistor M2 is connected to the data line Dm, and the second electrode is connected to one end of the storage capacitor Cst. In addition, the gate electrode of the second transistor M2 is connected to the scanning line Sn. The above-mentioned second transistor M2 is turned on when the scanning signal is supplied to the scanning line Sn, and then supplies the data signal from the data line Dm to one end of the storage capacitor Cst.

The storage capacitor Cst is connected between the first power supply ELVDD and the gate electrode of the first transistor M1. The above-mentioned storage capacitor Cst is charged with a voltage in response to the data signal.

Figure 5:
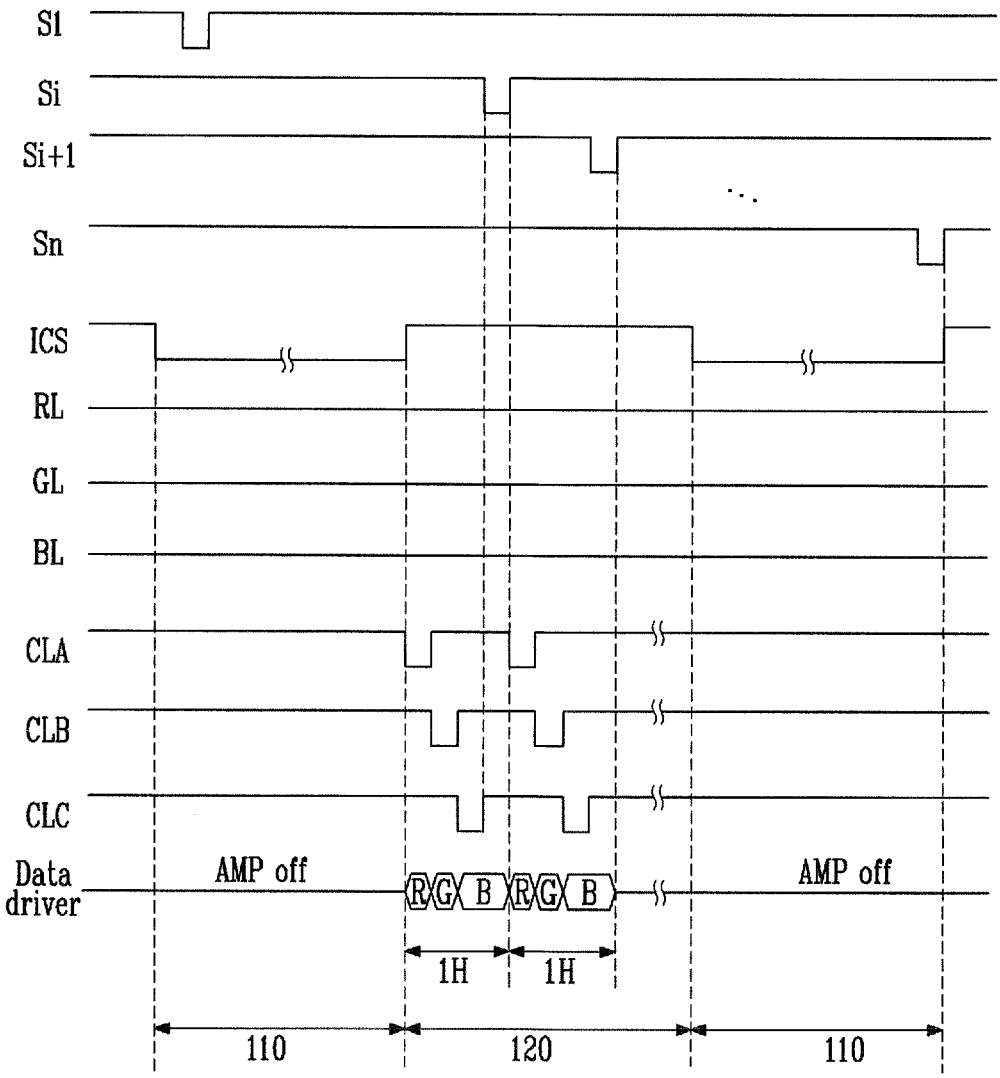
FIG. 5 is a driving waveform that is supplied when driving in a standby mode according to an embodiment of the present invention.

Turning now to FIG. 5, FIG. 5 is a driving waveform that is supplied when driving in a standby mode according to an embodiment of the present invention. Referring to FIG. 5, the data driver 200 is set to the off state during the period for supplying the scanning signal to the non-display region 110. For example, the data driver 200 can be driven by blocking power supplied to the amp (buffer) of the data driver. Simultaneously, the inspecting control signal ICS is supplied to the inspecting unit 600 from the timing controller 500 during the period for supplying the scanning signal to the non-display region 110.

When the inspecting control signal ICS is supplied to the inspecting unit 600, the switching elements SW1, SW2, SW3 are turned on. When the switching elements SW1, SW2, SW3 are turned on, each data line D1 to Dm is connected to any one of the first to third inspecting lines BL, GL, RL. With this configuration, the voltage in response to the black data signal is supplied to the first to third inspecting lines BL, GL, RL, so that the black data signal can be supplied to the data lines D1 to Dm.

With this configuration, the pixels 101 are supplied with the black data signal supplied to the data lines D1 to Dm via the inspecting unit 600 during the period when the scanning signal is being supplied to the standby non-display region 110. Therefore, the pixels 101 arranged in the standby non-display region 110 are set to the non-light emitting state.

The data driver 200 is driven in a normal state during the period when scanning signals are being supplied to the standby mode display region 120. In other words, three data signals R. G, B are sequentially supplied to each output line O1 to Ok in response to the data driving control signal (DCS) that is sequentially supplied. With this configuration, the data signals are supplied to the data lines D1 to Dm according to the demux control signal CLA, CLB, CLC.

The data signals supplied to the data lines D1 to Dm are supplied to the pixels 101 arranged within the standby mode display region 120 while supplying the scanning signal. With this configuration, the pixels within standby mode display region 120 generate a fixed image in response to the icon that is desired for display.

In the above-mentioned present invention, the data signal is not supplied to the data lines D1 to Dm from the data driver 200 during the period when the scanning signal is being supplied to the standby mode non-display region 110 during the standby mode, so that power consumption can be minimized.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and-equivalents thereof.

What is claimed is:

1. A method, comprising:

providing a mother substrate including at least one organic light emitting diode (OLED) display device;

testing the at least one OLED display device on the mother substrate by supplying from an inspecting unit a plurality of inspecting signals to data lines of the OLED display device; then separating the at least one OLED display device from the mother substrate; then sequentially supplying a scanning signal to both a standby mode display region and a standby mode non-display region of a pixel unit of the OLED display device after being separated from the mother substrate and while the OLED display device is in a standby mode;

supplying a data signal in response to a display image via a data driver while the supplying of the scanning signal to the standby mode display region of the pixel unit; and supplying a data signal corresponding to a black image via the inspecting unit to the standby mode non-display region upon the supplying the scanning signal to the standby mode non-display region of the pixel unit, wherein the inspecting unit supplying the data signal corresponding to the black image is in response to inspecting control signals supplied directly from a timing controller, and wherein the data driver supplying the data signal in response a display image is in response to a data driving control signal supplied directly from the timing controller.

2. The method of claim 1, wherein the inspecting unit includes a plurality of switching elements respectively arranged between a plurality of inspecting lines and a plurality of data lines, the switching elements being turned on when the scanning signal is being supplied to the standby mode non-display region, wherein the inspecting lines are supplied with a voltage that corresponds to the data signal corresponding to a black image.

3. The method of claim 1, wherein the data lines include lines $D_1$ to $D_m$, wherein the inspecting unit comprises:

a plurality of first switching elements arranged between a first inspecting line and ones of every third data line $D_1$, $D_4 \ldots D_{m-2}$;

a plurality of second switching elements arranged between a second inspecting line and ones of every third data line $D_2$, $D_5 \ldots D_{m-1}$;

a plurality of third switching elements arranged between a third inspecting line and ones of every third data line $D_3$, $D_6 \ldots D_m$, each of the first, second and third switching elements being turned on upon the inspecting control signals being applied, allowing every third data line $D_1$, $D_4 \ldots D_{m-2}$ to be electrically connected to the first inspecting line, every third data line $D_2$, $D_5 \ldots D_{m-1}$ to be electrically connected to the second inspecting line, and every third data line $D_3$, $D_6 \ldots D_m$ to be electrically connected to the third inspecting line, thereby supplying black image data to the data lines, each of the first, second and third switching elements being a single transistor.

4. The method of claim 3, wherein the inspecting lines are also used to test the mother substrate prior to the separating of the OLED display device from the mother substrate.

5. The method of claim 1, further comprising stopping a supply of power to a buffer within the data driver upon the scanning signal being supplied to the standby mode non-display region during the standby mode.

6. The method of claim 1, the inspecting unit supplying a data signal only to non-display portions of the pixel unit and only when the display device is in the standby mode.

7. The method of claim 1, wherein current does not flow to pixels in the standby mode non-display region of the pixel unit when the display device is in the standby mode.

8. The method of claim 1, an amount of current that flows to the pixel unit in standby mode is less than an amount of current that flows to the pixel unit in a normal driving mode.

9. The method of claim 1, wherein the data driver is set to an off state during said supplying the data signal corresponding to the black image via the inspecting unit to the standby mode non-display region of the pixel unit upon the supplying the scanning signal to the standby mode non-display region of the pixel unit.

10. The OLED display device of claim 1, wherein the OLED display device further includes a demux unit arranged between the data driver and the pixel unit that receives demux control signals from the timing controller and supplies the data signal from the data driver to the pixel unit in response to the demux control signals.

11. The method of claim 1, the timing controller being directly connected to the inspecting unit, the data driver being external to and separated from the timing controller.

12. An organic light emitting diode (OLED) display device, comprising:

a scanning driver to supply a scanning signal to scanning lines during a driving mode and during a standby mode;

a data driver to supply a data signal representative of an image to data lines in response to a data driving control signal and while the scanning signal is being supplied to a standby mode display region of the pixel unit during the standby mode;

an inspecting unit to supply a black data signal voltage corresponding to a black image to the data lines when the scanning signal is being supplied to a standby mode non-display region of the pixel unit during the standby mode; and a timing controller to directly supply an inspecting control signal to the inspecting unit and to directly supply the data driving control signal to the data driver, the inspecting unit supplying a data signal only to non-display portions of the pixel unit and only when the display device is in the standby mode, the inspecting unit to also supply inspecting signals to the data lines when inspecting the mother substrate and before the OLED display device is separated from the mother substrate.

13. The OLED display device of claim 12, wherein the inspecting unit comprises:

a plurality of inspecting lines that are supplied with the voltage corresponding to the black image when the OLED display device is in the standby mode, the inspecting lines being also used to test a mother substrate that includes the OLED display device during an inspection of the mother substrate when the OLED display device is attached to the mother substrate; and a plurality of switching elements that are respectively arranged between the data lines and the inspecting lines and being turned on when the inspecting control signal is being supplied.

14. The OLED display device of claim 13, the timing controller to supply the inspecting control signal when the scanning signal is being supplied to the standby mode non-display region during the standby mode.

15. The OLED display device of claim 12, further comprising cutting off a supply of power to a buffer within the data driver upon the scanning signal being supplied to the standby mode non-display region during the standby mode.

16. The OLED display device of claim 12, further comprising a demux unit arranged between the data lines and an output of the data driver, the timing controller to supply demux control signals to the demux unit to operate the demux unit.

17. The OLED display device of claim 12, wherein current does not flow to pixels in the pixel unit that are arranged in the standby mode non-display region of the display device when the display device is in the standby mode.

18. The OLED display device of claim 12, an amount of current that flows to a pixel unit of the display device in the standby mode is less than an amount of current that flows to the pixel unit in the driving mode.

19. The OLED display device of claim 12, wherein the data driver is set to an off state upon the inspecting unit supplying the black data signal voltage corresponding to the black image to the data lines when the scanning signal is being supplied to the standby mode non-display region of the pixel unit during the standby mode.

20. The OLED display device of claim 12, wherein the data lines include lines $D_1$ to $D_m$, wherein the inspecting unit comprises:

a plurality of first switching elements arranged between a first inspecting line and ones of every third data line $D_1$, $D_4 \ldots D_{m-2}$;

a plurality of second switching elements arranged between a second inspecting line and ones of every third data line $D_2$, $D_5 \ldots D_{m-1}$;

a plurality of third switching elements arranged between a third inspecting line and ones of every third data line $D_3$, $D_6 \ldots D_m$, each of the first, second and third switching elements being turned on upon the inspecting control signals being applied, allowing every third data line $D_1$, $D_4 \ldots D_{m-2}$ to be electrically connected to the first inspecting line, every third data line $D_2$, $D_5 \ldots D_{m-1}$ to be electrically connected to the second inspecting line, and every third data line $D_3$, $D_6 \ldots D_m$ to be electrically connected to the third inspecting line, thereby supplying black image data to the data lines.

* * * * *